US010471710B2

(12) United States Patent
Khalate

(10) Patent No.: US 10,471,710 B2
(45) Date of Patent: Nov. 12, 2019

(54) METHOD FOR DETECTING DISTURBANCE IN DROPLET EJECTION OF AN INKJET PRINT HEAD

(71) Applicant: Océ Holding B.V., Venlo (NL)

(72) Inventor: Amol A. Khalate, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 16/111,937

(22) Filed: Aug. 24, 2018

(65) Prior Publication Data

US 2018/0361735 A1 Dec. 20, 2018

Related U.S. Application Data

(63) Continuation of application No. PCT/EP2017/053463, filed on Feb. 16, 2017.

(30) Foreign Application Priority Data

Feb. 25, 2016 (EP) ..... 16157271

(51) Int. Cl.
*B41J 2/045* (2006.01)
*B41J 2/14* (2006.01)

(52) U.S. Cl.
CPC ..... *B41J 2/0451* (2013.01); *B41J 2/04588* (2013.01); *B41J 2/14* (2013.01); *B41J 2002/14354* (2013.01)

(58) Field of Classification Search
CPC ..... B41J 29/393; B41J 2/0451; B41J 2/2142; B41J 2/04588; B41J 29/38; B41J 2002/14354; B41J 2/04596; B41J 2/14
See application file for complete search history.

(56) References Cited

U.S. PATENT DOCUMENTS

2005/0116977 A1 6/2005 Shinkawa et al.

FOREIGN PATENT DOCUMENTS

EP 1 865 311 A1 12/2007
WO WO 2010/023135 A1 3/2010
WO WO 2012/175593 A1 12/2012

OTHER PUBLICATIONS

International Search Report issued in PCT/EP2017/053463 (PCT/ISA/210), dated Apr. 24, 2017.

(Continued)

*Primary Examiner* — Jannelle M Lebron
(74) *Attorney, Agent, or Firm* — Birch, Stewart, Kolasch & Birch, LLP

(57) ABSTRACT

In a method for detecting a disturbance in an ejection unit of an inkjet print head, the ejection unit of the inkjet print head includes a pressure chamber for holding an amount of liquid and is in fluid communication with a nozzle orifice; and an actuator operatively coupled to the pressure chamber for generating a pressure wave in the liquid in the pressure chamber for ejecting a droplet of the liquid through the nozzle orifice upon application of a droplet ejection pulse. The method determining at least one resonance frequency of the pressure chamber; determining a disturbance detection pulse for generating a pressure wave in the liquid in the pressure chamber taking into account the resonance frequencies previously determined, wherein the disturbance detection pulse has a frequency spectrum different from a frequency spectrum of the droplet ejection pulse; detecting a residual pressure wave in the liquid in the pressure chamber; and analyzing the residual pressure wave previously detected for determining whether a disturbance for droplet ejection is present in the ejection unit. With this method, disturbances in the ejection unit may be derived from the residual pressure wave more reliably and easier.

8 Claims, 4 Drawing Sheets

(56) References Cited

OTHER PUBLICATIONS

Written Opinion of the International Searching Authority issued in PCT/EP2017/053463 (PCT/ISA/237), dated Apr. 24, 2017.

METHOD FOR DETECTING DISTURBANCE IN DROPLET EJECTION OF AN INKJET PRINT HEAD

CROSS-REFERENCE TO RELATED APPLICATIONS

This application is a Continuation of PCT International Application No. PCT/EP2017/053463, filed on Feb. 16, 2017, which claims priority under 35 U.S.C. § 119 to Application No. 16157271.4, filed in Europe on Feb. 25, 2016. The entirety of each of the above-identified applications is expressly incorporated herein by reference.

BACKGROUND OF THE INVENTION

1. Field of the Invention

The present invention generally pertains to a method for detecting a disturbance in an ejection unit of an inkjet print head and an inkjet printer configured to perform the method.

2. Background of the Invention

A well known inkjet print head comprises an ejection unit. The ejection unit comprises a pressure chamber for holding an amount of liquid and is in fluid communication with a nozzle orifice. Further, the ejection unit comprises an actuator operatively coupled to the pressure chamber for generating a pressure wave in the liquid in the pressure chamber for ejecting a droplet of the liquid through the nozzle orifice upon application of a droplet ejection pulse. A common embodiment applies a piezo-electric transducer as an actuator.

It is known to detect a residual pressure wave in the above-mentioned inkjet print head and to analyze the residual pressure wave for determining whether an obstruction or any other disturbance in the operation of the ejection unit is present. For example, an air bubble may have become trapped in the pressure chamber. Such air bubble changes the acoustic properties in the pressure chamber, thereby affecting the droplet generation properties of the ejection unit. Due to the presence of an air bubble in the pressure chamber, a droplet may be expelled with a deviating speed, a deviating size or may not be generated at all.

For detecting a residual pressure wave, it is known to generate a droplet ejection pulse, thereby potentially expelling a droplet, and then to detect the residual pressure wave. Expelling a droplet during analysis is usually undesired and therefore it is also known to apply a disturbance detection pulse having a same shape as a droplet ejection pulse, but with reduced amplitude, due to which no droplet will be expelled. Still, both the droplet ejection pulse and the pulse with reduced amplitude result in a residual pressure wave that may not reveal all potential disturbances clearly.

In another known embodiment, a disturbance detection pulse may have a different shape than the droplet ejection pulse. In this known embodiment, the disturbance detection pulse is adapted to identify a particular disturbance. In particular, an air bubble in the pressure chamber has a particular resonance frequency, depending on its size. Droplet ejection is only affected if the air bubble exceeds a certain critical size. Using a sine wave pulse having a frequency corresponding to the resonance frequency of an air bubble having said critical size, it is easy and simple to detect the presence of such an air bubble. However, in order to determine the presence of any disturbance in the ejection unit, such disturbance specific detection pulse is unsuitable. It would require a large number of disturbance specific detection pulses to identify the most common and regularly occurring disturbances.

It is desirable to have a disturbance detection pulse for detecting a disturbance in an inkjet ejection unit that reveals the presence of any one of a number of disturbances clearly.

SUMMARY OF THE INVENTION

In a first aspect of the present invention, a method according to the present invention includes the method steps of a) determining at least one resonance frequency of the pressure chamber; b) determining a disturbance detection pulse for generating a pressure wave in the liquid in the pressure chamber taking into account the resonance frequencies determined in step a), wherein the disturbance detection pulse has a frequency spectrum different from a frequency spectrum of the droplet ejection pulse; c) detecting a residual pressure wave in the liquid in the pressure chamber; and d) analyzing the residual pressure wave detected in step c) for determining whether a disturbance for droplet ejection is present in the ejection unit.

The method of the present invention has been conceived in view of the insight that the resonance frequencies of the pressure chamber determine the residual pressure wave, if no disturbance is present. Consequently, if a disturbance is present, the frequency response in the residual pressure wave will be most affected at the resonance frequencies of the pressure chamber. In order to excite the resonance frequencies most, the disturbance detection pulse should be and can be designed particularly for that purpose. It is within the ordinary skill of the skilled person to design such a resonance-exciting disturbance detection pulse.

In an embodiment, in step a), at least two resonance frequencies are determined. In such embodiment, the method may further comprise a step a1) of determining a damping factor for each resonance frequency determined in step a) and step b) may further comprise taking into account the respective damping factor for each resonance frequency determined in step a). Certain resonances damp more quickly than other resonances. Since the residual pressure wave is detected over a period of time, due to the damping differences, one of the resonances may have significantly higher amplitude in the frequency spectrum of the residual pressure wave than the other resonances.

In an embodiment, such difference in damping may be compensated for by the amount of excitation of the respective resonance frequencies. So in such embodiment, in steps a) and a1), a first resonance frequency with a strong damping is determined and a second resonance frequency with a weak damping is determined. Then, in step b), the frequency spectrum of the disturbance detection pulse is determined to have a higher amplitude in the frequency spectrum at the first resonance frequency than at the second resonance frequency. It is noted that the use of 'strong damping' and 'weak damping' are to be considered relative to each other. So, essentially, the damping at the first resonance frequency is stronger than at the second resonance frequency.

In an embodiment, the droplet ejection pulse has a shape represented by a predetermined set of parameters and the disturbance detection pulse has a similar shape represented by the same predetermined set of parameters. In order to provide for a different frequency spectrum of the disturbance detection pulse, the disturbance detection pulse has parameter values that are different from the parameter values of the droplet ejection pulse. For example, a well known trapezoidal droplet ejection pulse may be represented by a rise time, a dwell time and a fall time. By selecting at least one of these parameters to have a different value, a different corresponding frequency spectrum results. Only changing one or more of these values enables to provide for a specific disturbance detection pulse without requiring complex and expensive circuitry for enabling to generate any kind of pulse shape.

In an embodiment, in step a) of the method, at least two resonance frequencies are determined and the method further comprises a step a2) of determining a disturbance relevance for each resonance frequency determined in step a). The disturbance relevance represents the relevance of the resonance frequency for detecting a disturbance in the ejection unit. Step b) further comprises taking into account the respective disturbance relevance for each resonance frequency determined in step a2). As one resonance frequency may be more relevant to disturbance detection than another resonance frequency, the disturbance detection pulse may be adapted to exciting such more relevant resonance frequency more than such less relevant resonance frequency. For example, in steps a) and a2), a first resonance frequency with a small disturbance relevance is determined and a second resonance frequency with a large disturbance relevance is determined. Then, in step b), the frequency spectrum of the disturbance detection pulse is determined to have a higher amplitude in the frequency spectrum at the second resonance frequency than at the first resonance frequency. Such disturbance detection pulse will excite the second resonance frequency stronger, rendering any deviation in the residual pressure wave at that resonance frequency more pronounced.

In an embodiment, step a) comprises determining a frequency response spectrum of the pressure chamber and step b) comprises taking into account the frequency response spectrum for determining the disturbance detection signal. In such embodiment, not only the resonance frequencies are taken into account, but the whole frequency response spectrum is taken into account. This allows even more control over the residual pressure wave and the possibilities to deduct the presence of disturbances therefrom.

In a second aspect of the present invention, an inkjet printer is configured and adapted to perform the method according to the present invention. For example, the inkjet printer is provided with a control unit for controlling the operation of the inkjet print head. In particular, the control unit is configured to generate a droplet ejection pulse and to generate a disturbance detection pulse. Further, the control unit is configured and adapted to receive a signal representing the residual pressure wave and to analyze the residual pressure wave. The disturbance detection pulse may be predetermined and stored in a memory unit of the control unit or the disturbance detection pulse may be dynamically determined, e.g. once per predetermined period or each time that the inkjet printer is switched on, by determining the actual resonance frequencies of one, multiple or each pressure chamber.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1A:
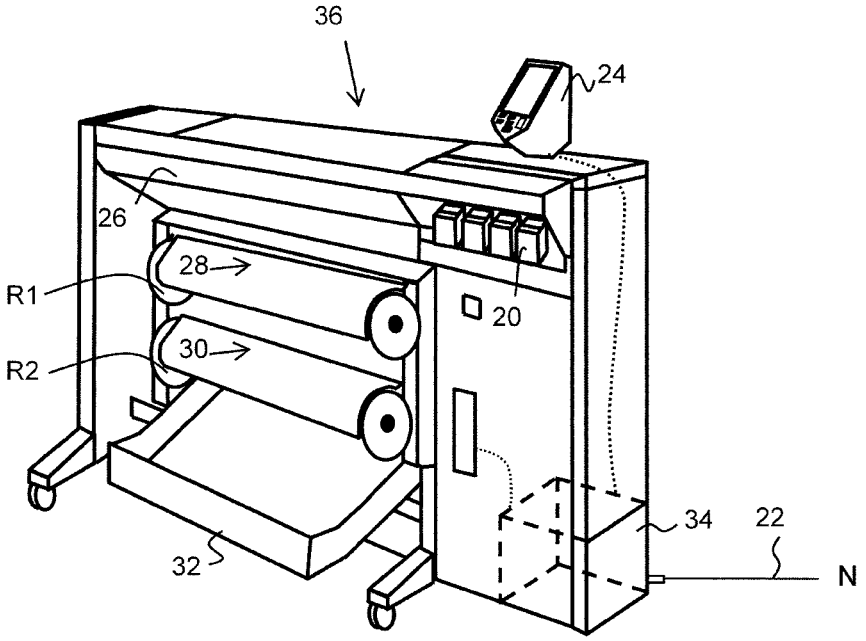
FIG. 1A is a perspective view of an exemplary inkjet printer.

The present invention will now be described with reference to the accompanying drawings, wherein the same or similar elements are identified with the same reference numeral.

Figure 1B:
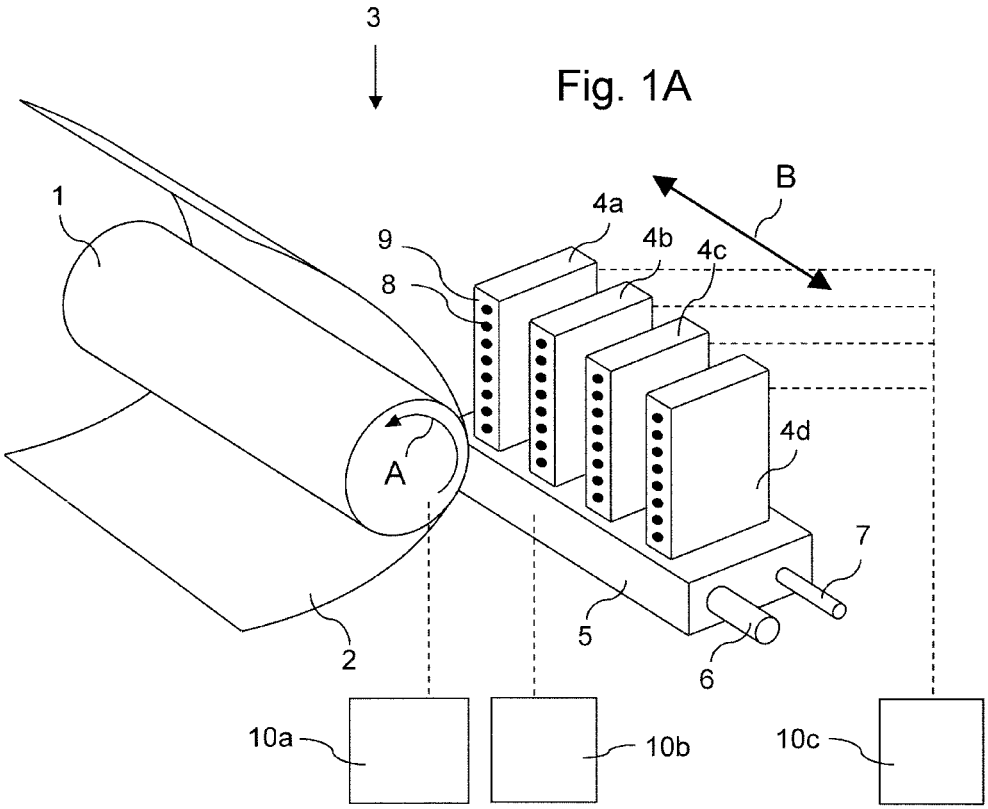
FIG. 1B schematically illustrates a scanning inkjet printing method.

FIG. 1A shows an image forming apparatus 36, wherein printing is achieved using a wide format inkjet printer. The wide-format image forming apparatus 36 comprises a housing 26, wherein the printing assembly, for example the ink jet printing assembly shown in FIG. 1B, is placed. The image forming apparatus 36 also comprises a storage configured to store image receiving members 28, 30, a delivery station to collect the image receiving members 28, 30 after printing and a storage configured to store marking material 20. In FIG. 1A, the delivery station is embodied as a delivery tray 32. Optionally, the delivery station may comprise processer configured to process the image receiving member 28, 30 after printing, e.g. a folder or a puncher. The wide-format image forming apparatus 36 further comprises means for receiving print jobs and optionally means for manipulating print jobs. These means may include a user interface unit 24 and/or a control unit 34, for example a computer.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display and a control panel. Alternatively, the control panel may be integrated in the display, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises a support configured to support an image receiving member 2. The support is shown in FIG. 1B as a platen 1, but alternatively, the support may be a flat surface. The platen 1, as depicted in FIG. 1B, is a rotatable drum, which is rotatable about its axis as indicated by arrow A. The support may be optionally provided with suction holes for holding the image receiving member in a fixed position with respect to the support. The ink jet printing assembly 3 comprises print heads 4*a*-4*d*, mounted on a scanning print carriage 5. The scanning print carriage 5 is guided by suitable guides 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controls 10*a*, 10*b* and 10*c*, respectively.

The image receiving member 2 may be a medium in web or in sheet form and may be composed of, e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guides 6, 7. These guides 6, 7 may be rods as depicted in FIG. 1B. The rods may be driven by suitable drives (not shown). Alternatively, the carriage 5 may be guided by other guides, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9 may negatively influence the ejection of droplets and the placement of these droplets on the image receiving member 2. Therefore, it may be advantageous to remove excess ink from the orifice surface 9. The excess ink may be removed, for example, by wiping with a wiper and/or by application of a suitable anti-wetting property of the surface, e.g. provided by a coating.

For use with the present invention, the print heads 4*a*-4*d* have a number of ejection units, each ejection unit corresponding to one of the orifices 8. An ejection unit comprises a liquid chamber in which a pressure wave may be generated, e.g. by suitably driving a piezo-electric element (i.e. an electromechanical transducer) associated with the ejection unit. The pressure wave may be such that a droplet of marking material (liquid) is expelled through the corresponding orifice or the pressure wave may be such that no droplet is expelled. The latter is commonly known for vibrating a meniscus of the marking material, for example. Likewise, a non-expelling pressure wave is known for use with an acoustic sensing method for detecting an operating state of the ejection unit. For example, if an air bubble is entrained in the liquid chamber of the ejection unit, the acoustics in the liquid chamber are different compared to the situation where no air bubble is present. As a consequence, a generated pressure wave will be different, too. Detecting and analyzing the pressure wave, which is referred to herein as the residual pressure wave, allows determining an operating state of the ejection unit. This method is known in the prior art and to the skilled person. Therefore, this method is not further elucidated herein.

Figure 2A:
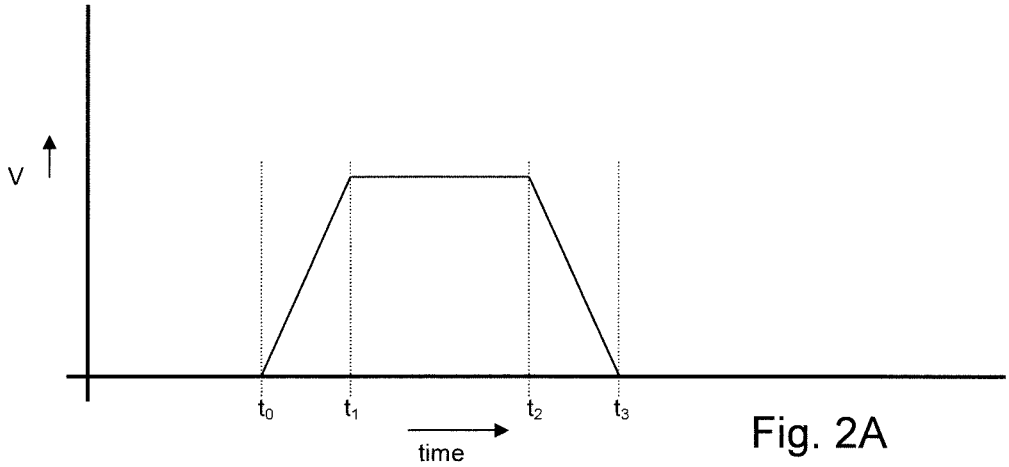
FIG. 2A shows an exemplary actuation pulse for actuating an inkjet print head actuator.

FIG. 2A illustrates an actuation pulse for actuating an actuator of an inkjet print head for increasing and decreasing a volume of a pressure chamber, thereby generating a pressure wave in a liquid in the pressure chamber, as above described. Herein, the liquid may also be referred to as ink or fluid marking material, but the liquid may be any other liquid. The illustrated actuation pulse has a trapezoid shape, which is a commonly known pulse shape. Still, other shapes of the actuation pulse are contemplated and are within the scope of the present invention.

The trapezoid pulse starts from an initial voltage, may be 0 volt or any other suitable voltage, with a rise time from time t0 to time t1 to a predetermined maximum pulse voltage. The maximum pulse voltage is maintained during a dwell time running from time t1 to time t2. Then, in a fall time from time t2 to time t3, the voltage drops to the initial value again. The actuator is actuated to follow this cycle by increasing the pressure chamber volume during the rise time, maintaining the increased volume during the dwell time and subsequently reducing the pressure chamber volume during the fall time.

The actual duration of the rise time, dwell time and fall time determine a frequency spectrum of the actuation pulse. The frequency spectrum is derivable by performing a Fourier transformation, which is a mathematical method well known in the art and which is therefore not further elucidated herein.

The pressure chamber has a number of acoustical resonant modes, which are determined inter alia by the dimensions of the pressure chamber and physical properties of a medium, such as the liquid, present in the pressure chamber, wherein such physical properties are viscosity and density, for example. Depending on the frequency spectrum of the actuation pulse, such resonant modes are excited or not.

After actuation, i.e. after time t3, a residual pressure wave remains in the liquid in the pressure chamber, which residual pressure wave damps over time. The residual pressure wave shape depends strongly on the acoustical resonances in the pressure chamber. While such resonances mainly result from the resonant modes of the pressure chamber, further resonances may occur. For example, as above described, an air bubble may have become entrapped in the pressure chamber. Such air bubble may resonate at a certain frequency, which frequency depends on the size of the air bubble.

In order to expel a droplet from the inkjet print head, the acoustics, including the resonances in the pressure chamber and the shape of the actuation pulse, are adapted to generate a suitable pressure near the orifice such that an amount of liquid is pushed through the orifice, which amount then forms the droplet.

Figure 2B:
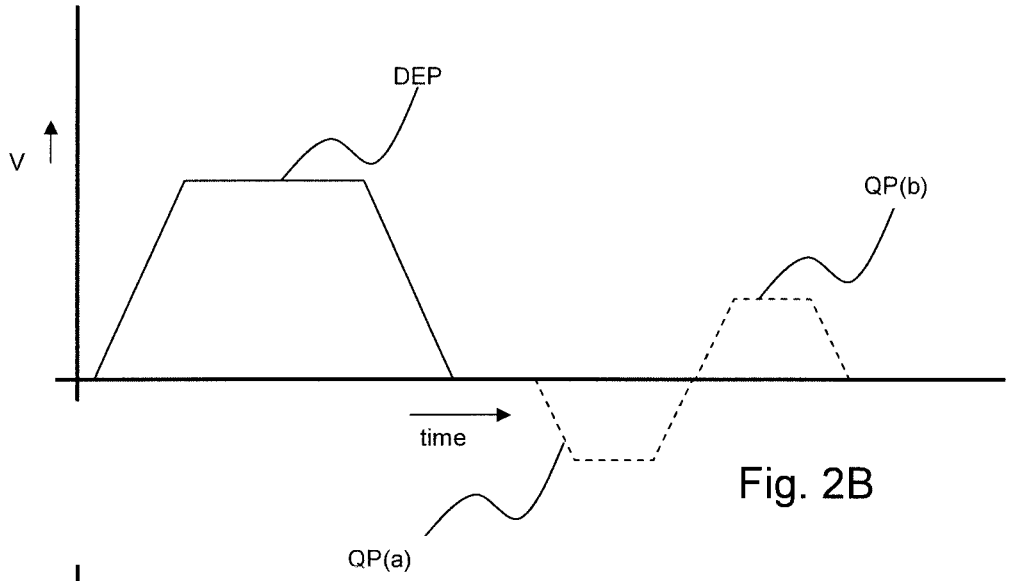
FIG. 2B shows a first exemplary droplet ejection pulse.

For sake of clarity, FIG. 2B illustrates a droplet ejection pulse DEP followed by a first quench pulse QP(a) or a second quench pulse QP(b), which suppress the residual pressure wave in the pressure chamber. One of these quench pulses is supplied to prepare the pressure chamber and the liquid contained therein for a next actuation such that the residual pressure wave does not affect the next droplet generation, for example. Such quench pulses are well known in the art. However, as used herein, the droplet ejection pulse DEP does not include such a quench pulse QP(a) or QP(b). The term 'droplet ejection pulse' as used herein only includes the pulse for actually expelling the droplet. So, as used herein, a disturbance detection pulse formed by the droplet ejection pulse DEP as shown in FIG. 2B without the quench pulse QP(a) or QP(b) is deemed to be a same actuation pulse having a same frequency spectrum.

Figure 3A:
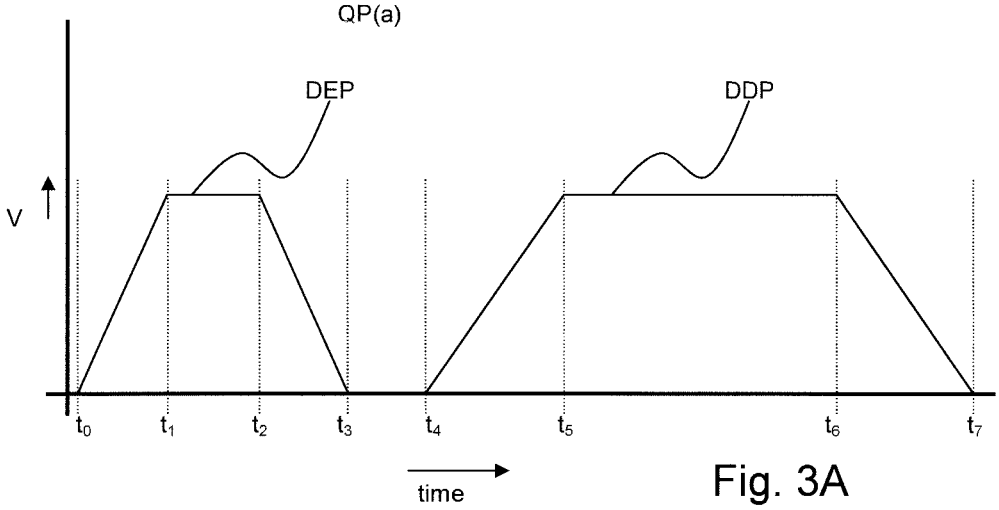
FIG. 3A shows a first embodiment of a droplet ejection pulse and a corresponding disturbance detection pulse according to the present invention.
Figure 3B:
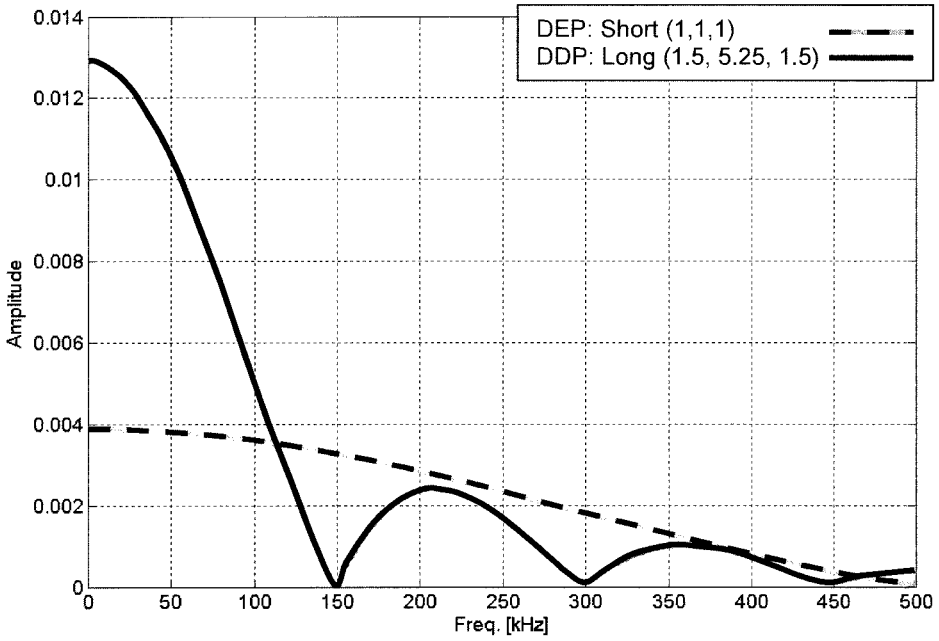
FIG. 3B shows a frequency spectrum for each of the droplet ejection pulse and disturbance detection pulse of FIG. 3A.
Figure 3C:
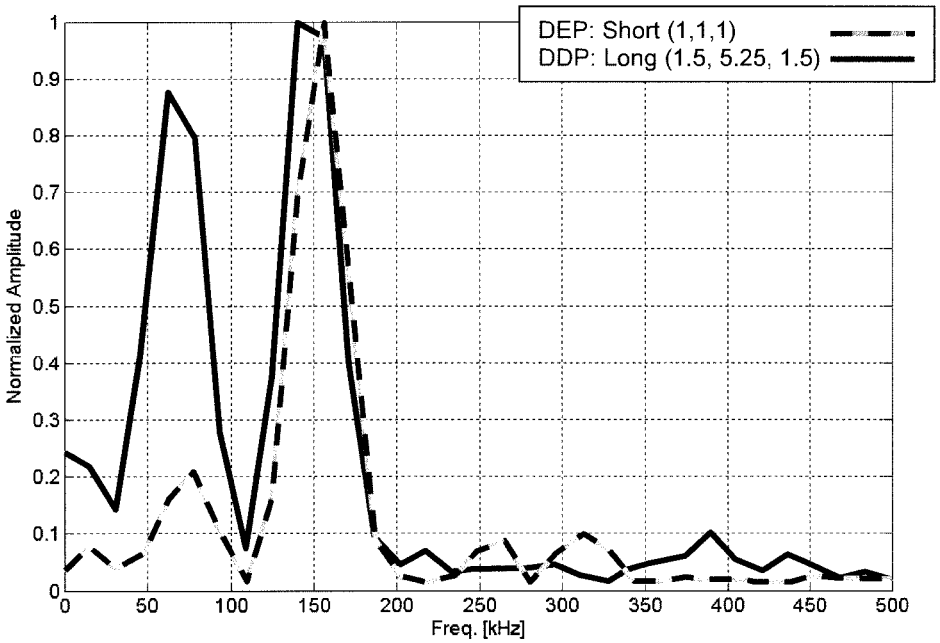
FIG. 3C shows a frequency spectrum for a residual pressure wave resulting from each of the droplet ejection pulse and disturbance detection pulse of FIG. 3A.

FIG. 3A illustrates a first embodiment of a droplet ejection pulse DEP and a corresponding disturbance detection pulse DDP. In particular, the disturbance detection pulse DDP deviates from the droplet ejection pulse not in its shape, but in a value of a number of parameters of the shape. The trapezoid pulse shape may be represented by three parameters: duration of the rise time, duration of the dwell time and the duration of the fall time. Considering the droplet ejection pulse DEP, the three values of the three parameters may be (1, 1, 1), meaning that the rise time, dwell time and the fall time have an equal duration. In an embodiment, these values may be actual microseconds, in which case the rise time is 1 microsecond, the dwell time is 1 microsecond and the fall time is 1 microsecond. In FIG. 3B the corresponding frequency spectrum is shown with a dashed curve. With a maximum at 0 kHz, the amplitude falls gradually to zero at about 500 kHz. Using the droplet ejection pulse DEP and then detecting the residual pressure wave, the residual pressure wave may have the frequency spectrum as shown in FIG. 3C (dashed curve). Clearly, a maximum is present at a frequency of about 150 kHz, which corresponds to a second resonant mode of the pressure chamber. A first resonant mode of the pressure chamber is present and derivable from the dashed curve in FIG. 3C at about 70 kHz. The amplitude of this first resonant mode is about a fifth of the amplitude at the second resonant mode at about 150 kHz. The difference in amplitude is known to be caused by a stronger damping at the first resonant mode than at the second resonant mode.

Thus, it is apparent that any disturbance causing the first resonant mode to be deviated will be more difficult to be identified than a disturbance affecting the second resonant mode. Moreover, it is known that common disturbances usually affect the first resonant mode more than the second resonant mode. Hence, the residual pressure wave resulting from the droplet ejection pulse DEP may not be the best option for readily revealing such common disturbances.

Returning to FIG. 3A, the disturbance detection pulse DDP has a different set of parameter values. Presuming the pressure chamber with a first resonant mode at about 70 kHz and a second resonant mode at about 150 kHz, wherein common disturbances are best revealed by the amplitude in the residual pressure wave at the first resonant mode of about 70 kHz, the disturbance detection pulse DDP is designed to suppress the second resonant mode at 150 kHz, or at least to amplify the residual pressure wave response at 70 kHz by more strongly exciting the first resonant mode at about 70 kHz. This may be achieved by a parameter value set (1.5, 5.25, 1.5), the parameter values representing microseconds. FIG. 3B illustrates the corresponding frequency spectrum (solid curve).

The frequency spectrum of the disturbance detection pulse DDP has a significantly higher amplitude at 0 kHz and falling off to about zero amplitude at about 150 kHz. At the first resonant mode at about 70 kHz, the amplitude is still more than about 60% of the maximum amplitude, while at the second resonant mode the amplitude is about zero.

FIG. 3C shows the frequency spectrum of the corresponding residual pressure wave (solid curve). Despite the suppression of the amplitude at 150 kHz in the disturbance detection pulse DDP, the second resonant mode still has the highest amplitude. On the other hand, the amplitude at about 70 kHz corresponding to the first resonant mode has almost the same amplitude. Clearly, any deviation in the first resonant mode caused by a disturbance is much easier detectable from a residual pressure wave having such a strong signal component from the first resonant mode.

As described, the disturbance detection pulse DDP as shown in FIG. 3A has a similar pulse shape as the droplet ejection pulse DEP, i.e. a trapezoid shape, with deviating parameter values. Such embodiment is very suitable and effective as the drive circuitry for generating the pulse shape may be kept simple and cost-effective.

Figure 4A:
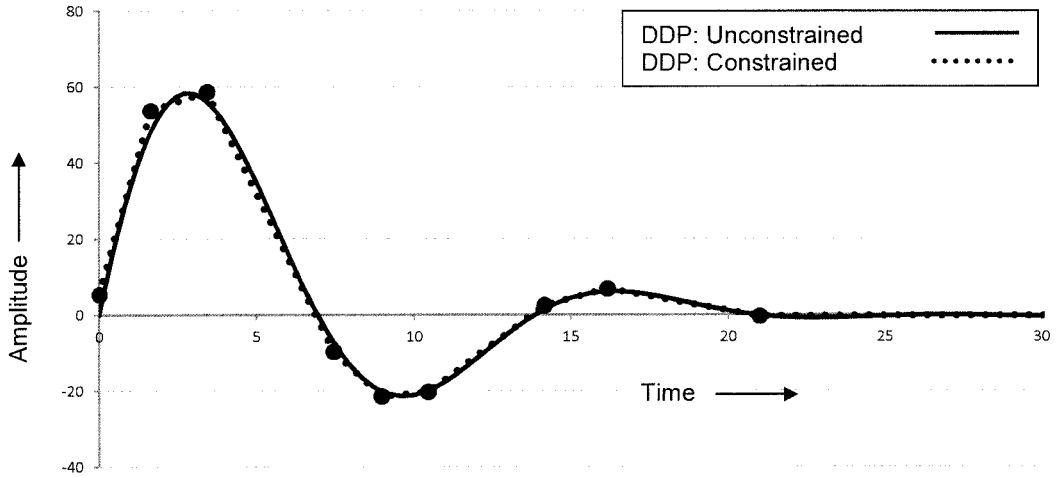
FIG. 4A shows a second and third embodiment of a disturbance detection pulse in accordance with the present invention.
Figure 4B:
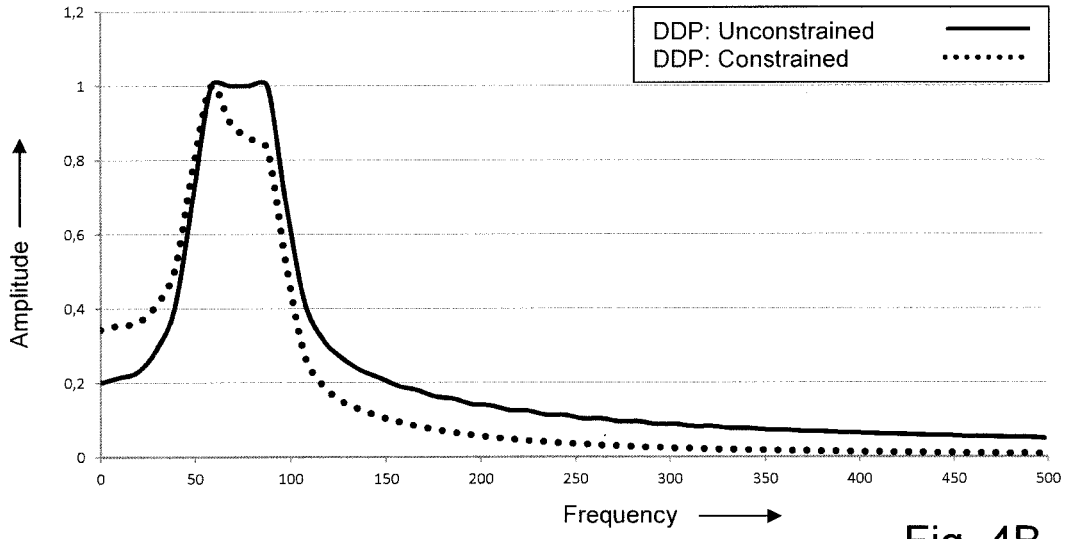
FIG. 4B shows a frequency spectrum for each of the second and third embodiment of FIG. 4A.

If a more complex and expensive drive circuitry is available, a more complex and even more effective disturbance detection pulse DDP may be used in the present invention. FIG. 4A shows a second and a third embodiment of such a disturbance detection pulse DDP. FIG. 4B shows the respective corresponding frequency spectra of the second and third embodiments of FIG. 4A.

FIG. 4A shows the second embodiment with a solid curve. The disturbance detection pulse DDP has been mathematically derived by determining all acoustic resonant modes in the frequency response spectrum of the pressure chamber and equalizing the amplitudes in the frequency spectrum of the residual pressure wave to an equal value, e.g. 1. It is noted that, in an embodiment, one or more resonant modes may be more relevant for detecting disturbances, in which case the amplitudes may be mathematically optimized to different values.

The second embodiment of the disturbance detection pulse DDP has been derived without imposing further constrains. As a result, the disturbance detection pulse DDP (unconstrained) has a gradually changing amplitude that becomes negative after about 7 microseconds until about 14 microseconds after its start. Its frequency spectrum (FIG. 4B, solid curve) is also gradually changing and has a broad peak in the frequency range from about 50 kHz to about 100 kHz. A noticeable difference with the frequency spectra shown in FIG. 3B is the amplitude at 0 kHz. While the amplitude at 0 kHz was at a maximum for both curves in FIG. 3B, the maximum amplitude is not at a maximum in this second embodiment.

The third embodiment is illustrated in FIG. 4A as a dotted curve. The third embodiment is a simplified embodiment of the second embodiment. While the second embodiment was unconstrained, it is commercially not reasonable to implement the second embodiment. A linearization of the second embodiment simplifies the drive circuitry to a technically and commercially feasible embodiment. Thereto, a between the embossed dots linearly changing amplitude is provided as a third embodiment, herein also referred to as a constrained disturbance detection pulse DDP (constrained). As is apparent from FIG. 4A, a difference between the second and the third embodiment is very small. The difference is however more clearly present in FIG. 4B. The dotted curve in FIG. 4B deviates significantly from the solid curve, although the basic shape and distribution in amplified and attenuated frequencies of the third embodiment is quite similar to the second embodiment: in the frequency range from about 50 kHz to about 100 kHz, the frequencies are amplified relative to the attenuated other frequencies.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an," as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for detecting a disturbance in an ejection unit of an inkjet print head, the ejection unit of the inkjet print head comprising:

a pressure chamber for holding an amount of liquid, said pressure chamber being in fluid communication with a nozzle orifice; and an actuator operatively coupled to the pressure chamber for generating a pressure wave in the liquid in the pressure chamber for ejecting a droplet of the liquid through the nozzle orifice upon application of a droplet ejection pulse, the method comprising the steps of:

a) determining at least one resonance frequency of the pressure chamber;

b) determining a disturbance detection pulse for generating a pressure wave in the liquid in the pressure chamber taking into account the resonance frequencies determined in step a), wherein the disturbance detection pulse has a frequency spectrum different from a frequency spectrum of the droplet ejection pulse;

c) detecting a residual pressure wave in the liquid in the pressure chamber; and d) analyzing the residual pressure wave detected in step c) for determining whether a disturbance for droplet ejection is present in the ejection unit.

2. The method according to claim 1, wherein the droplet ejection pulse has a shape represented by a predetermined set of parameters and wherein the disturbance detection pulse has a similar shape represented by the same predetermined set of parameters having values different from the values of the parameters for the droplet ejection pulse.

3. The method according to claim 1, wherein step a) further comprises the step of determining a frequency response spectrum of the pressure chamber, and wherein step b) further comprises the step of taking into account the frequency response spectrum for determining the disturbance detection signal.

4. The method according to claim 1, wherein in step a) at least two resonance frequencies are determined, the method further comprising the step of:

determining a damping factor for each resonance frequency determined in step a), and wherein step b) further comprises the step of taking into account the respective damping factor for each resonance frequency determined in the step of determining a damping factor.

5. The method according to claim 4, wherein the step a) and the step of determining a damping factor further comprise the steps of:

determining a first resonance frequency with a strong damping; and determining a second resonance frequency with a weak damping, and wherein step b) further comprises the step of determining the frequency spectrum of the disturbance detection pulse to have a higher amplitude in the frequency spectrum at the first resonance frequency than at the second resonance frequency.

6. The method according to claim 1, wherein in step a) at least two resonance frequencies are determined, the method further comprising:

determining a disturbance relevance for each resonance frequency determined in step a), the disturbance relevance representing the relevance of the resonance frequency for detecting a disturbance in the ejection unit, and wherein step b) further comprises the step of taking into account the respective disturbance relevance for each resonance frequency determined in the step of determining a disturbance relevance.

7. The method according to claim 6, wherein the step a) and the step of determining a disturbance relevance further comprise the steps of:

determining a first resonance frequency with a small disturbance relevance; and determining a second resonance frequency with a large disturbance relevance, and wherein step b) further comprises the step of determining the frequency spectrum of the disturbance detection pulse to have a higher amplitude in the frequency spectrum at the second resonance frequency than at the first resonance frequency.

8. An inkjet printer comprising an inkjet print head and a control unit operatively coupled to the inkjet print head for controlling operation of the inkjet print head, the inkjet print head comprising an ejection unit, wherein the ejection unit comprises:

a pressure chamber for holding an amount of liquid, said pressure chamber being in fluid communication with a nozzle orifice; and an actuator operatively coupled to the pressure chamber for generating a pressure wave in the liquid in the pressure chamber for ejecting a droplet of the liquid through the nozzle orifice upon application of a droplet ejection pulse, wherein the control unit is configured to supply the droplet ejection pulse to the inkjet print head for controlling the inkjet print head to expel a droplet of liquid through the nozzle orifice, and wherein the control unit is configured to supply a disturbance detection pulse, then to detect a residual pressure wave in the pressure chamber and to analyze the residual pressure wave for determining whether a disturbance is present in the ejection unit of the inkjet print head, the disturbance detection pulse being determined by taking into account at least one resonance frequency of the pressure chamber and having a frequency spectrum different from a frequency spectrum of the droplet ejection pulse.

* * * * *